US007644782B1

(12) United States Patent
Coogan et al.

(10) Patent No.: US 7,644,782 B1
(45) Date of Patent: Jan. 12, 2010

(54) METHOD FOR CORRECTING POSITIONING ERRORS IN ROCK DRILLING, AND ROCK DRILLING EQUIPMENT

(75) Inventors: John Coogan, Tampere (FI); Jussi Heikkola, Tampere (FI); Simo Sanerma, Lempäälä (FI)

(73) Assignee: Sandvik Intellectual Property AB, Sandviken (SE)

( * ) Notice: Subject to any disclaimer, the term of this patent is extended or adjusted under 35 U.S.C. 154(b) by 1472 days.

(21) Appl. No.: 09/857,688

(22) PCT Filed: Dec. 7, 1999

(86) PCT No.: PCT/SE99/02274

§ 371 (c)(1),
(2), (4) Date: Oct. 3, 2001

(87) PCT Pub. No.: WO00/34617

PCT Pub. Date: Jun. 15, 2000

(30) Foreign Application Priority Data

Dec. 9, 1998 (FI) ..... 982668

(51) Int. Cl.
*E21C 11/00* (2006.01)

(52) U.S. Cl. ..... 173/1; 173/2; 173/11; 173/190

(58) Field of Classification Search ..... 173/1, 173/2, 4, 11, 42, 190, 192, 44
See application file for complete search history.

(56) References Cited

U.S. PATENT DOCUMENTS 4,113,033 A 9/1978 Lindblad
4,343,367 A 8/1982 Mashimo
4,362,977 A 12/1982 Evans et al.
4,499,953 A 2/1985 Molin
4,514,796 A * 4/1985 Saulters et al. ..... 700/13
4,542,794 A * 9/1985 Bjor ..... 173/1
4,587,622 A * 5/1986 Herzog ..... 702/97
4,698,570 A * 10/1987 Satoh ..... 318/568.19
4,831,549 A * 5/1989 Red et al. ..... 700/254
4,979,575 A * 12/1990 Strom et al. ..... 173/1
5,279,372 A 1/1994 Rinnemaa
5,348,105 A 9/1994 Lappalainen et al.
5,383,524 A * 1/1995 Rinnemaa ..... 173/1

FOREIGN PATENT DOCUMENTS

GB 2 103 969 3/1983

* cited by examiner

*Primary Examiner*—Thanh K Truong
(74) *Attorney, Agent, or Firm*—Drinker Biddle & Reath LLP

(57) ABSTRACT

The invention relates to a method for correcting positioning errors in rock drilling, and a rock drilling equipment. Deviation of the boom position from the theoretical position is measured as a function of the position of at least one boom joint, the measured deviations are stored in the memory of the drilling rig, and when the boom is positioned to the drilling position, its position is corrected on the basis of the stored deviation. The drilling equipment includes a memory for storing the deviations between the true position of the boom and the theoretical position calculated on the basis of the joint sensor values, and a calculating device for correcting the boom position on the basis of the deviations stored in the memory of the drilling rig.

12 Claims, 1 Drawing Sheet

METHOD FOR CORRECTING POSITIONING ERRORS IN ROCK DRILLING, AND ROCK DRILLING EQUIPMENT

BACKGROUND OF THE INVENTION

The invention relates to a method for correcting positioning errors in rock drilling, where a boom, attached from one end to a carrier and turnable in relation to it about joints, and a rock drill, mounted turnable to the other end of the boom, are arranged in the drilling position for drilling a hole in a way that the boom is controlled using control devices of the drilling rig in relation to various movements until the boom is in its set position, wherein the deviation of the boom's actual position from the calculated theoretical position is measured, and the boom's position is corrected on the basis of the measured deviation.

Further, the invention is related to a rock drilling equipment, with a carrier, a boom attached turnable about joints in relation to the carrier, a rock drill attached turnable to the other end of the boom, joint sensors indicating the positions of the various boom joints, and control devices for controlling the boom to the drilling position for drilling a hole.

Higher and higher precision is required of the operation of a rock drilling rig so that excavating could be made as economic as possible. Today, automatic drilling boom positioning and controlling devices are more often used with the purpose of enabling the holes to be drilled as precisely as possible at their intended positions. For practical controlling purposes, various types of joint sensors are attached to booms, and the aim is to take into account the geometrical dimensions of the booms and their kinematics as well as possible when calculating the drill position and direction. The problem with automatic control solutions realized in this manner is, however, that different types of deflections, clearances and other things causing error result in that the actual position of the drill bit may considerably differ from the position where it should be according to the plan.

U.S. Pat. No. 4,698,570 presents a solution where the aim is to correct errors of known equipment by dividing the operating range of the drilling boom, i.e., the reach of the boom in one carrier position, into squares and with a specific correction value assigned for each square in all directions of the coordinate system. This is achieved in practice by setting the equipment to control the boom and the feed beam so that the drill bit is, in theory, at the center of the square in question, after which the errors in the different directions are measured and fed into the memory of the control equipment. In normal drilling use, the rig corrects the boom and feed beam positions in accordance with the square at which the intended hole position is located on the basis of the stored, fixed correction values of the square in question. The problem with this solution is that a tight grid must be used for the area to be drilled in order to get sufficient correction data for the various boom positions. Further, as the drill bit can be positioned at one specific location using a number of different boom positions, a correction system based on the mere location of the drill bit is unable to compensate for the different errors based on different boom positions and, thus, the intended precision is not reached.

SUMMARY OF THE INVENTION

The object of this invention is to provide a method and equipment, to avoid the errors of the known solutions and to reliably, and as easily and simply as possible, correct the errors caused by boom movements.

The method according to the invention is characterized in that the deviation of the boom position from the theoretical position is measured at predetermined intervals as a function of the position of at least one boom joint, that the measured deviations are stored in the memory of the drilling rig, and that when the boom and the rock drill are positioned to the drilling position, the position is corrected on the basis of the stored deviation that corresponds to the position of the joint corresponding to the said drilling position.

The drilling equipment according to the invention is characterized in that it includes a memory device for storing the deviations between the true position of the boom and the theoretical position calculated on the basis of the joint sensor values as a function of the turning angle of at least one boom joint, and a calculating device for correcting the boom position on the basis of the deviations stored in the said memory device and corresponding to the value indicated by the joint sensor of the said joint.

The essential idea of the invention is to determine at least the errors of those of the different boom movements mainly causing an error, i.e., the deviations between the true boom position and the theoretical position, calculated on the basis of the movement sensor, primarily of the set value indicated by the angle sensor of the turning angles, corresponding to the movement in question, one movement at a time or two movements at a time practicably in relation to the movement at suitable intervals and by correcting the boom position on the basis of the errors, i.e., deviations, measured in relation to movement or movements in question and for each movement separately. This enables, for instance, the defining of errors on the basis of the turning angles between the boom and the carrier, and on the basis of the rotation angles of the rotation mechanism of the feed beam, i.e., so-called roll-over mechanism. Still, the essential idea of one preferred embodiment of the invention is that when the errors at set values positioned at suitable intervals have been determined and stored in the memory of the control device, a mathematical approximation regarding the alteration of the error is formed between two measured points when moving from one point to the other whereby, when a position is located in such an area, sufficiently accurate approximations for correcting the error are available.

The advantage of a method according to the invention is that already by defining the errors as a function of the main joints and their turning angles, relatively accurate information on the errors of the boom position is available and, thus, it is easy to correct the error in the various boom and feed beam positions by compensating just the errors caused by the most significant sources of error. This means that a relatively small amount of correcting data need to be fed into the memory of the control device, which makes controlling easier to carry out. Further, when the change of deviation between the measured points is calculated mathematically, a sufficiently accurate approximation of the error between the measured values is always obtained, and the total error and the resulting required compensation can be calculated using error definitions made at relatively large intervals. This diminishes the number of measuring points required for the definition of deviation.

BRIEF DESCRIPTION OF THE DRAWING

The objects and advantages of the invention will become apparent from the following detailed description of a preferred embodiment thereof in connection with the accompanying drawing, in which like numerals designate like elements, and in which.

DETAILED DESCRIPTION OF A PREFERRED EMBODIMENT OF THE INVENTION

Figure 1:
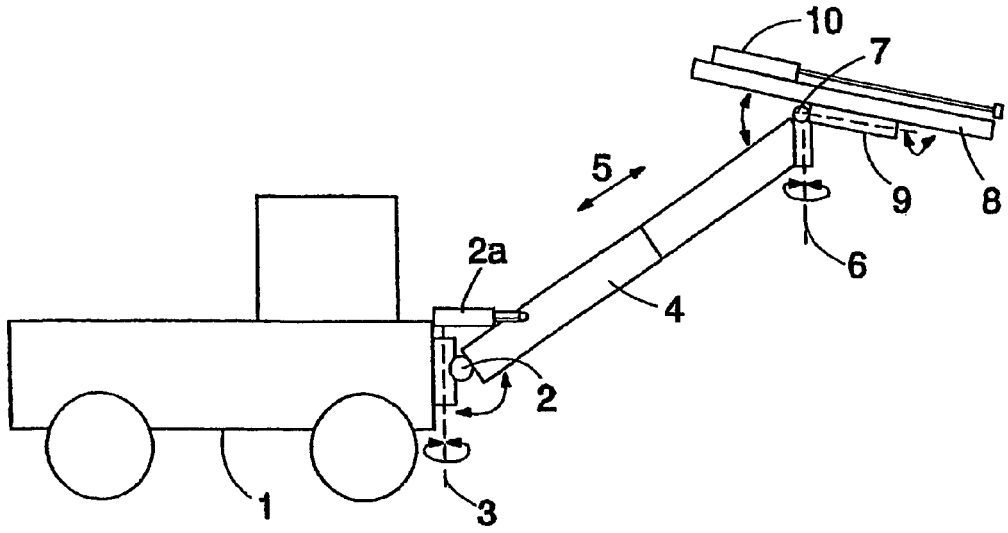
FIG. 1 is a schematic view of a boom used in a rock drilling rig.

FIG. 1 schematically presents a rock drilling rig with a carrier 1 and a boom 4 pivotally connected about joints 2 and 3. The boom can be turned in relation to the carrier and other boom movements can be accomplished using various actuators of known type, such as the hydraulic cylinder 2*a* schematically presented in the drawing. Such actuators that are of a known type as such and self-evident to the person skilled in the art, are not explained in any detail in the drawing. The boom can be of any known type or of a construction that can be constructed or assembled in a normal way. The boom can consist of one or more parts that can, during boom movements, be turned at the joints or the axles between them or, for instance, be moved linearly in relation to one another. In this patent application and patent claims, boom movements mean all these turning, rotating, or linear movements between the boom and the carrier, the different parts of the boom, as well as between the boom and the feed beam attached to its end. The boom 4 can be, for instance, a telescopic boom whose length can be adjusted longer or shorter in the direction indicated by the arrow 5. At the top end of the boom 4, there are the turning joints 6 and 7 around which the feed beam 8 can be turned in relation to the boom end. Further, it may include a rotating device 9 to which the feed beam 8 is attached parallel to the axis of the rotating device, so that the feed beam 8, and the rock drill 10 moving along it, can be rotated around the said axis while their direction remains unchanged.

Figure 2:
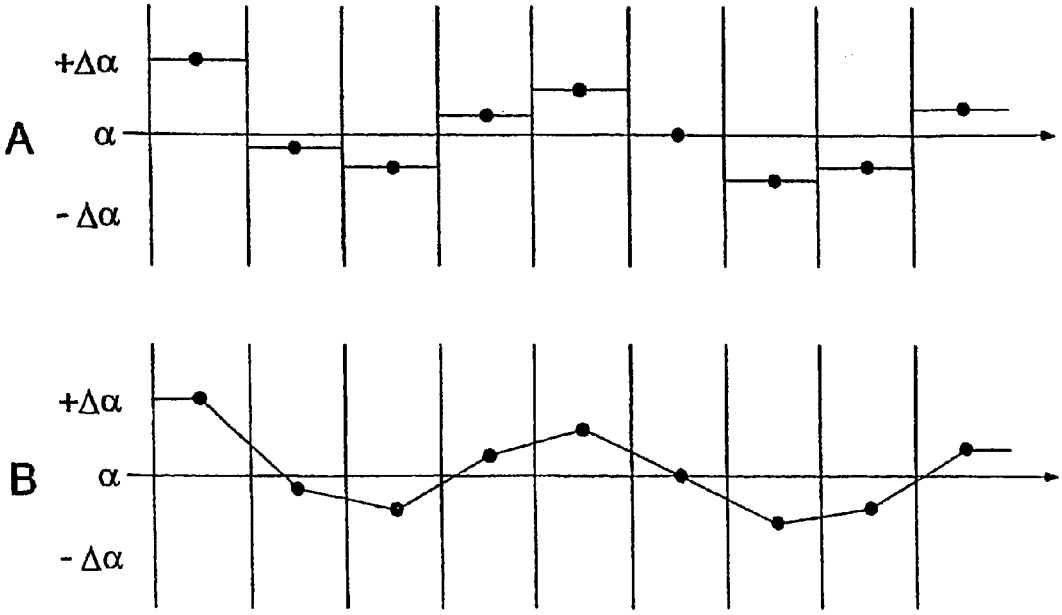
FIG. 2 schematically presents the defining of error as a function of one joint, e.g., the turning angle of the joint between the boom and the carrier of the rock drilling rig.

FIG. 2 schematically presents how the error occurring at different angle positions of a single joint, exemplified in this case by the horizontal swing joint between the boom and the carrier, can be defined according to the invention. For this purpose, the turning angle is divided into ten sectors so that, in theory, when a command is given to the control device to turn the boom to a certain angle, it will be positioned precisely at the defined angle.

In order to determine the error, the boom is turned with the aid of the control device, for instance, one defined angle sector at a time, which is then carried out on automatic rigs by the control device on the basis of the signals given by the movement sensors, in this case the angle sensors. Correspondingly, on non-automatic rigs, the operator uses the maneuvering controls to turn the boom in the desired direction until the intended angle is reached.

In each boom position, the deviation of the boom position from the theoretical position is measured, and the errors are stored in the memory. This gives the upper error diagram, marked with A, presented in FIG. 2, which is stored for use in the memory of the control equipment, i.e., the control device that is usually a single unit. The deviations of boom position are simple to express as deviation of the position of the rock drill tool, i.e., the drill bit, and as deviation of the rock drill drilling direction, i.e., the axis of the drill steel between the rock drill and the drill bit. Defined in this way, the error is unambiguous and correction of the error in the co-ordinate system related to the rock is easy to accomplish. In the case represented in diagram A, a fixed error value is used in a certain span, whereby the positive or negative error value, i.e., the deviation, of a measuring point indicated by a dot is used for correction on both sides of the measuring point halfway between two measuring points. In order to obtain some kind of probable value between the accurate measuring points, an error correction curve is formed like, for instance, the one in diagram B of FIG. 2 so that the error values between adjacent turning angles are combined and the error deviation is calculated on the basis of this. A linear change is the simplest to use, whereby a mathematically straight line between the error values is calculated when moving from one position to the other and, on the basis of the turning angle, the approximation for the error. This is illustrated in diagram B of FIG. 2 by the straight lines drawn between the measured dots shown in diagram A of FIG. 2. Instead of straight lines, various kind of non-linear approximations can, naturally, be used but, in most cases, this is not necessary.

When the deviations according to the joint turning angle, i.e., the errors, have been defined related to one joint axis, they are then defined in a corresponding manner for the turning angles of the other joint axis of the same joint. Further, if the feed beam is mounted to the end of the boom using a rotation mechanism, the errors caused by the turning angles of the rotation mechanism are measured and stored in the memory. Accomplished in this way, the most significant causes of error can be taken into consideration, and the final error affecting the position of the drill bit can be defined by adding up the error values of each component. This provides an effective and reliable control method with a relatively small number of measured error values, with the said method taking into consideration the effect of the various components of the boom on the error of the drill bit position as a result of the various positions of the boom and its parts. In practice, a simpler way to correct the error is to correct the error emerging as a function of each turning movement on the basis of the measured deviation values corresponding to each movement, whereby the result is that the drill bit is due to the error corrections quite accurately in its designed location and the drilling axis in the desired direction.

During actual drilling operation, whereby the deviations have been separately measured and stored in advance in the memory organs of the drilling rig's control devices, the correction of the position on rigs with automatic control is realized automatically so that when the control devices starts controlling the boom with the aim to move it to the desired drilling location, an error correction related to each movement is carried out automatically so that the calculated set value for the boom position is corrected on the basis of the deviation values stored in the memory. In this way, the whole correction of drilling and positioning error can be done fully automatically for each hole to be drilled according to a drill plan made pursuant to any generally applied method. In manual implementations, the control devices of the rock drilling rig, i.e., the memory and calculating equipment automatically take into account the deviation corresponding to the turning angle and correct, for instance, the readings of the display indicating the boom position in a way that they show the true position of the boom, such as the drill bit position and the drilling direction without the operator in practice even noticing that the correction of an error has taken place.

The invention has been presented in the above descriptions and in the drawings in the form of examples only, and it is by no means restricted to that. The essential thing is that the errors, i.e., the deviation values, affecting the drill bit position are defined as results of the various movement positions of the boom joints, boom parts, and components, and that the error is corrected on the basis of the measured deviation values, one or more movements at a time. This can be done taking into consideration all the joints or, more preferably, just the most significant errors caused by movements of joints or components on the basis of which the total error affecting the drill bit position can be sufficiently accurately calculated and then corrected with sufficient accuracy.

The deviations of each movement, i.e., the errors as a function of the joints positions can also be modelled as a continuous function over the whole travel of the movement and, thus, for e.g., turning angles as angle deviation values over the whole turning angle range. If highest possible error correction accuracy is desired, it is, naturally, necessary to define the deviation of each movement from the set value and to make the correction for each movement.

The invention claimed is:

1. A method for correcting positioning errors in rock drilling occurring in a drilling rig comprising a boom and a rock drill, the boom attached at one end thereof to a carrier and being turnable in relation to it about one or more joint axes of one or more respective joints, the rock drill being turnably mounted to another end of the boom, the apparatus arranged in a drilling position for drilling a hole in a way that the boom is controlled using control devices of the drilling rig wherein the boom is subjected to various movements until the boom is in a desired set position, wherein a deviation of the boom's actual turning angle about one of said joint axes from a desired turning angle about said one of said joint axes is measured using a movement sensor, and the boom's position is corrected on the basis of the measured deviation, the method comprising the steps of:

A) storing, in a memory, a first set of deviations obtained by turning the boom through incremental turning angles about said one of said joint axes from a reference position to predetermined angularly spaced intervals about said one of said joint axes, and measuring using a movement sensor, for each such interval, a deviation of the boom position from a desired incremental turning angle, and B) using the stored first set of deviations during a subsequent drilling operation as correction values for locating the boom at the desired incremental turning angles corresponding to the respective predetermined angularly spaced intervals about said one of said joint axes.

2. The method according to claim 1 wherein step A further comprises storing a second set of deviations obtained independently of the first set of deviations by turning the boom through incremental turning angles about a second one of said one or more joint axes of one or more respective joints from a reference position to predetermined angularly spaced intervals about said second one of said one or more joint axes and measuring using a movement sensor, for each such interval, a deviation of the boom position from a desired incremental turning angle; step B comprising using the stored second set of deviations during the drilling operation as correction values for locating the boom at the desired incremental turning angles corresponding to the respective predetermined angularly spaced intervals about said second one of said one or more joint axes.

3. The method according to claim 1 wherein an outer section of the boom is linearly extendable and retractable relative to an inner section thereof, step A further comprising storing another set of deviations obtained independently of the first set of deviations by moving the outer section from a reference position to linearly spaced intervals and measuring, for each linearly spaced interval, a deviation of the boom outer section from a desired position; step B comprising using the stored other set of deviations during the drilling operation as correction values to locate the boom in the desired positions corresponding to the linearly spaced intervals.

4. The method according to claim 1 wherein deviations occurring at a location between two of the angularly spaced intervals is determined by calculating an approximation based upon the measured deviations at the two angularly spaced intervals.

5. A method for correcting positioning errors in a rock drilling rig, the rock drilling rig comprising:

a boom attached at one end to a carrier and being rotatable in relation to the carrier about a plurality of joints;

a rock drill being turnably mounted to the other end of the boom; and control devices for controlling the boom through various positions until the boom is set in a drilling position for drilling a hole;

wherein a deviation of the boom's drilling position is measured from a calculated theoretical position of where the boom should be located for drilling, and the boom's drilling position is corrected on the basis of the measured deviation, the method comprising the steps of:

storing in memory, a set of deviations obtained by turning the boom through the various positions and measuring, at predetermined angular intervals about at least one joint, the deviation of the boom's position from a calculated theoretical position at each interval, and using the set of stored deviations to correct the drilling position of the boom relative to the at least one joint.

6. The method according to claim 5, wherein the deviation of the boom position from the calculated theoretical position at each interval is measured in the turning direction of at least one joint between the boom and the carrier.

7. The method as claimed in claim 5, wherein the method is employed for rotations about each of the plurality of joints, such that a set of deviations and an error compensation function are provided for boom movements relating to each of the plurality of joints.

8. The method according to claim 5, wherein the deviations corresponding to each joint position are measured at predefined angular intervals in a certain joint position value and, when positioning the boom to the drilling position, the calculated theoretical position of the boom is corrected on the basis of the deviations corresponding to the joint positions obtained in this way.

9. The method according to claim 8, wherein the deviation between adjacent, stored joint positions of each turning movement is defined by calculating an approximation for the change of deviation from one position value to the other on the basis of the measured deviations between the said joint position values.

10. The method according to claim 9, wherein the approximation for the deviation is calculated between the deviation values stored in a memory.

11. The method according to claim 5, wherein deviation caused by at least one other movement is measured as a function of the value of a movement sensor, and the theoretical position of the boom is corrected on the basis of the deviation corresponding additionally to this movement when positioning the boom to the drilling position.

12. The method according to claim 5, wherein the deviations are stored as deviations of the drill bit position of the rock drill and deviations of the drilling direction determined by the drill steel axis.

* * * * *